US007485004B2

(12) United States Patent
Liu et al.

(10) Patent No.: US 7,485,004 B2
(45) Date of Patent: Feb. 3, 2009

(54) ELECTRICAL CONNECTOR HAVING IMPROVED ELECTRICAL ELEMENT

(75) Inventors: Zhi-Jian Liu, Kunshan (CN); Zheng-Hua Xu, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,236

(22) Filed: Jan. 17, 2008

(65) Prior Publication Data

US 2008/0171454 A1 Jul. 17, 2008

(51) Int. Cl.
*H01R 13/66* (2006.01)

(52) U.S. Cl. ..... 439/620.25

(58) Field of Classification Search ..... 439/620.17, 439/620.18, 620.21, 620.22, 620.23, 620.25
See application file for complete search history.

(56) References Cited

U.S. PATENT DOCUMENTS 6,102,741 A * 8/2000 Boutros et al. ..... 439/620.06
6,428,361 B1 * 8/2002 Imschweiler et al. ..... 439/676
6,918,791 B2 * 7/2005 Wan et al. ..... 439/620.21
6,986,684 B1 * 1/2006 Lien ..... 439/620.07

FOREIGN PATENT DOCUMENTS

TW 486169 5/2002

* cited by examiner

*Primary Examiner*—Briggitte R Hammond
(74) *Attorney, Agent, or Firm*—Wei Te Chung

(57) ABSTRACT

An electrical connector (1) has a base portion (22), a number of terminals (3) mounted to the base portion, a first circuit board (42) assembled to the base portion, a substrate paralleled with the base portion and a number of pins (212) mounted on the substrate and a second circuit board (41) electrically engaging with the number of pins. The first and the second circuit boards together defines a receiving space (6). The electrical connector further has a number of electrical elements (5) received in the receiving space and together electrically connecting with the first circuit board and the second circuit board.

14 Claims, 3 Drawing Sheets

ELECTRICAL CONNECTOR HAVING IMPROVED ELECTRICAL ELEMENT

BACKGROUND OF THE INVENTION

1. Field of the Invention

The present invention relates to an electrical connector, and particularly to an electrical connector having a plurality of electrical elements for preventing electromagnetic interference (EMI).

2. Description of the Prior Art

A conventional modular jack mounted to an electrical connector is disclosed in TW Patent No. 486169 issued on May 01, 2002. The connector has a base board defining a plurality of terminal slots, a number of first terminals received in the terminal slot, a substrate parallel to the base board and a plurality of pins assembled to the substrate. The first terminal has a first end mating with a mating plug and a second end extending beyond the terminal slots. The electrical connector further comprises a printed circuit board electrically connected the base board to the substrate. The printed circuit board is provided with a plurality of first terminal holes engaging with the second ends of first terminals and a plurality of second terminal holes coupling with the pins. A plurality of electrical elements are soldered to the printed circuit board, thus forming a conductive trace between the first terminals, the printed circuit board and the pins.

During assembling, however, it is difficult to solder a plurality of electrical elements on a limited printed circuit board, and it is easy to cause a mutual collision between the electrical elements.

Hence, an improved electrical connector is needed to solve the above problem.

BRIEF SUMMARY OF THE INVENTION

One object of the present invention is to provide an electrical connector having larger enough space for receiving a plurality of electrical elements.

The present invention provides an electrical connector mounted on a printed circuit board. The electrical connector comprises a base portion defined a plurality of terminal slots, a plurality of terminals received in the terminal slots, a substrate paralleled with the base portion and a plurality of pins mounted on the substrate, a first circuit board electrically engaging with the terminals and a second circuit board electrically engaging with the plurality of pins. The first and the second circuit boards together define a receiving space. The electrical connector further includes a plurality of electrical elements received in the receiving space and electrically connecting with the first circuit board and the second circuit board.

Advantages of the present invention are to provide a first circuit board and a second circuit board on which a number of electrical elements are soldered. Therefore, the electrical connector has enough space adapted for locating the electrical elements and avoiding mutual collision between the electrical elements.

Other objects, advantages and novel features of the invention will become more apparent from the following detailed description of the present embodiments when taken in conjunction with the accompanying drawings.

DETAILED DESCRIPTION OF THE INVENTION

Figure 1:
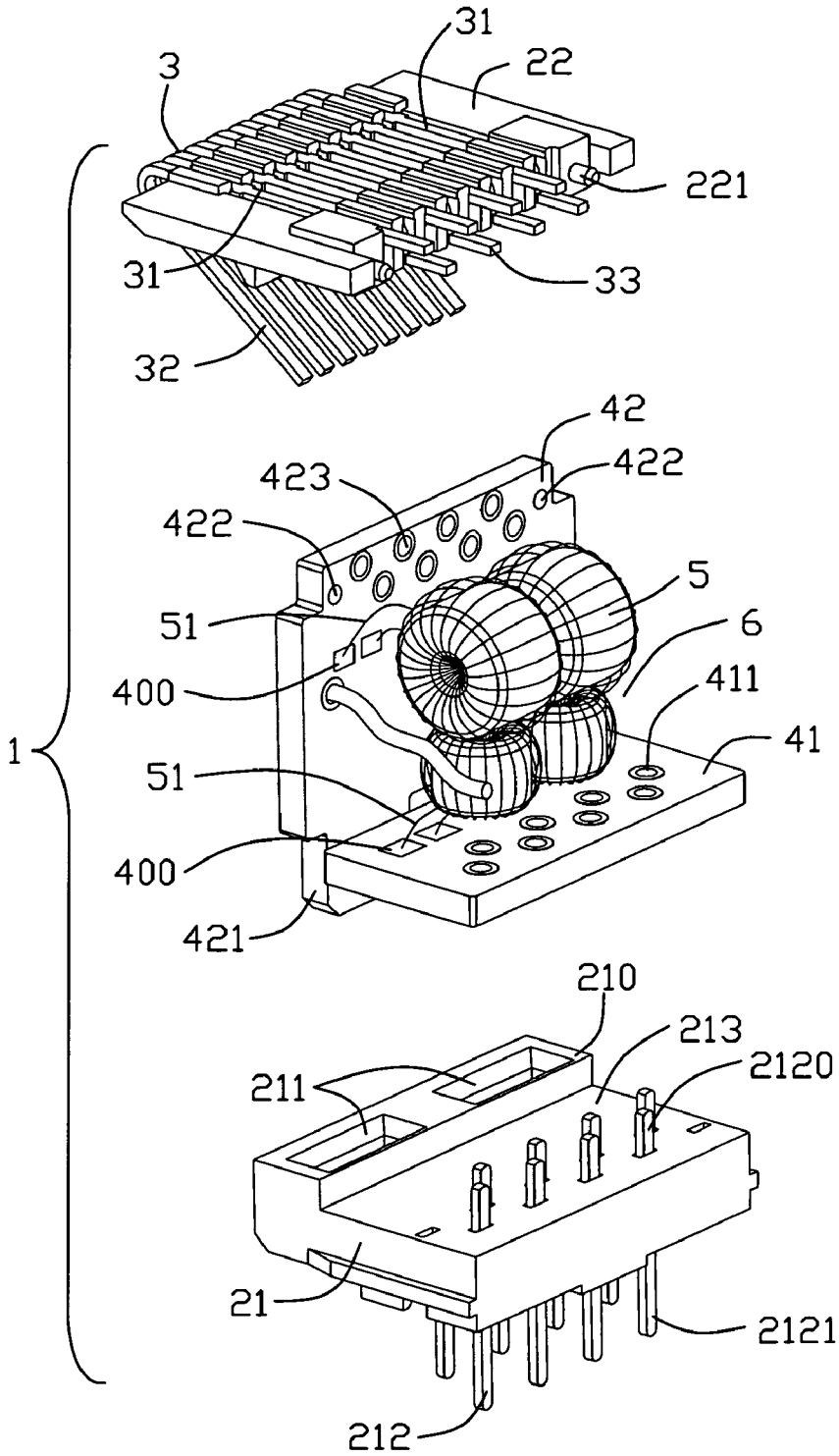
FIG. 1 is an exploded view of an electrical connector according to the present invention.

Reference will now be made to the drawing figures to describe the present invention in detail. Referring to FIG. 1, an electrical connector 1 in accordance with the present invention comprises a base portion 22, a plurality of terminals 3 mounted to the base portion 22, a first circuit board 42 assembled to the base portion 22, a second circuit board 41 and a substrate 21 having a plurality of pins 212 mounted to the substrate 21. The electrical connector 1 is provided with a plurality of electrical elements 5 such as coil chokes. The electrical elements 5 has a plurality of wires 51 both soldered to the first circuit board 42 and the second circuit board 41.

Figure 2:
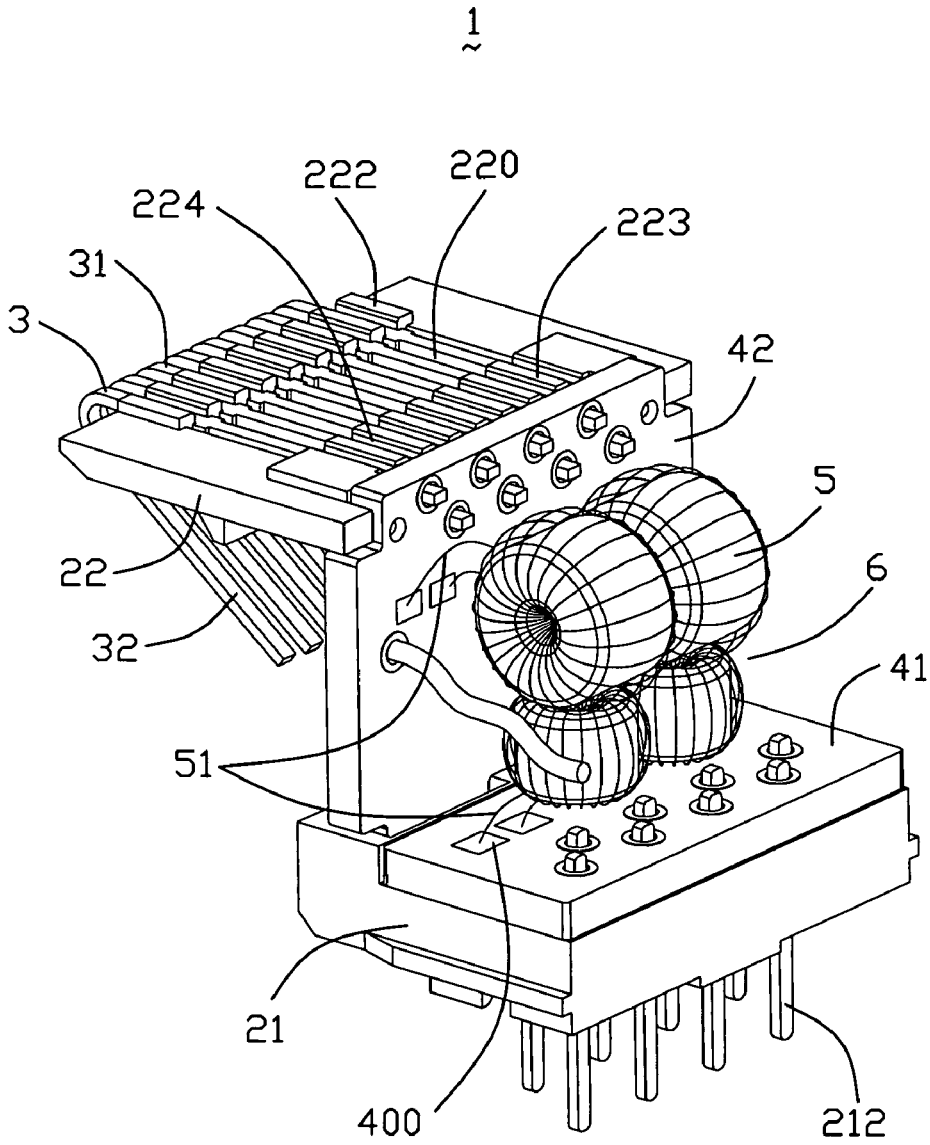
FIG. 2 is assembled perspective view of the electrical connector as shown in FIG. 1.
Figure 3:
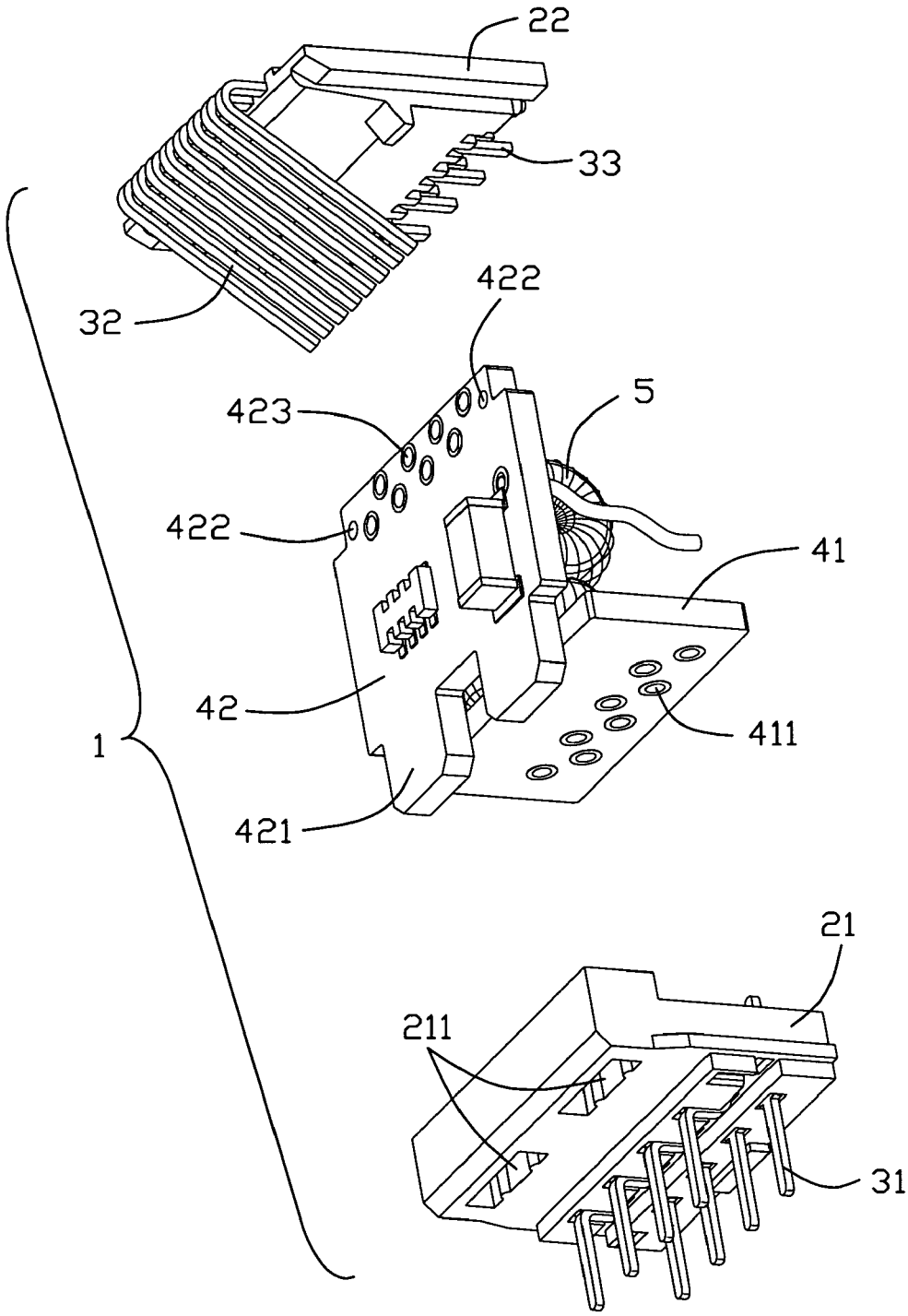
FIG. 3 is another exploded view similar to FIG. 1, taken from another aspect.

As shown in FIGS. 1-3, the base portion 22 has two arrays of rectangular protrusions 222, 223 paralleled with each other and arranged along regular intervals lengthwise along opposite sides of top surface of the base portion 22. The base portion 22 comprises an indentation 220 defined between the two arrays of rectangular protrusions 222, 223 and a plurality of terminal slots each formed between two adjacent rectangular protrusions 222 or 223 and communicating with the indentation 220. Each rectangular protrusions 222 and 223 is provided with a rib 224 disposed on an inner side face thereon for engaging with the terminal 3. The terminal 3 is retained in the terminal slot 200 firmly. The base portion 22 further has a pair of corresponding posts 221 extending form a side face thereof. Each terminal 3 has an elongate portion 31 received in the terminal slot 200 and a contacting portion 32 bent from the elongate portion 31 for engaging with a mating plug. The terminal 3 further comprises a tail portion 33 extending from the elongate portion 31 and beyond the base portion 22.

The substrate 21 is parallel with the base portion 22 and has an planar portion 213 and a step portion 210 defining a pair of holes 211 thereon. A plurality of pins 212 are assembled to the planar portion 213 and each pin 212 has a first contacting end 2120 extending through a plurality of vias 411 defined on the second circuit board 41 and a second contacting end 2121 extending downwardly from the substrate 21 for engaging with a printed circuit board.

The first circuit board 42 is perpendicularly assembled to the base portion 22 and has a pair of projecting portions 421 extending downwardly therefrom and received in the holes 211 of the substrate 21. The first circuit board 42 includes a pair of passages 422 respectively defined on side edge thereof for engaging with the corresponding posts 221 of the base portion 22. A plurality of first holes 423 are provided on a top portion of the first circuit board 42 for engaging with tail portions 33 of the terminals 3. Therefore, the first circuit board 42 is firmly fixed between the base portion 22 and the substrate 21. The second circuit board 41 is mounted on the planar portion 213 of the substrate 21 thus being perpendicularly to the first circuit board 42. At the same time, the first contacting ends 2120 of the pins 212 extend through the vias 411 of the second circuit board 41. The first circuit board 42 and the second circuit board 41, respectively, has a pair of pads 400 for electrically connecting the wires 51 of the electrical elements 5. Thus the electrical elements 5 are located in a receiving space 6 formed between the first circuit board 22 and second circuit board 41. At that time, a conductive trace is formed between the terminals 3, the first and second circuit board 42, 41, and the pins 212.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for mounting on a printed circuit board, comprising:

a base portion comprising two arrays of protrusions, an indentation defined between the two arrays of protrusions, and a plurality of terminal slots each formed between every two adjacent protrusions and communicating with the indentation;

a plurality of terminals received in the terminal slots;

a substrate paralleled with the base portion and a plurality of pins mounted on the substrate;

a first circuit board electrically engaging with the terminals;

a second circuit board electrically engaging with the plurality of pins, the first and the second circuit boards together defining a receiving space; and a plurality of electrical elements received in the receiving space and electrically connecting with the first circuit board and the second circuit board.

2. The electrical connector as claimed in claim 1, wherein said electrical elements comprise a plurality of wires connecting to the first and the second circuit board, respectively.

3. The electrical connector as claimed in claim 1, wherein said second circuit board is perpendicular to the first circuit board.

4. The electrical connector as claimed in claim 1, wherein said protrusion has a pair of side faces each having a rib, and the terminals are retained in the terminal slots by the ribs.

5. The electrical connector as claimed in claim 1, wherein said substrate has a planar portion and a step portion defining a pair of holes, and wherein said first circuit board has a pair of projecting portions mounted within the holes.

6. The electrical connector as claimed in claim 5, wherein said second circuit board is located on the planar portion and has a plurality of vias for coupling with the pins.

7. The electrical connector as claimed in claim 6, wherein each of said pins has a first contacting end extending through the via of the second circuit board and a second contacting end extending downwardly from the substrate for engaging with the printed circuit board on which the electrical connector is mounted.

8. The electrical connector as claimed in claim 1, wherein each terminal has an elongate portion, a contacting portion extending obliquely from the elongate portion and a tail portion extending from the base portion.

9. The electrical connector as claimed in claim 8, wherein said first circuit board is provided with a plurality of vias for engaging with the tail portions of the terminals.

10. An electrical connector comprising:

a base portion comprising two arrays of protrusions and an indentation defined between the two arrays of protrusions, and a plurality of terminal slots each formed between every two adjacent protrusions and communicating with the indentation;

a plurality of contacts disposed in the base portion; and first and second printed circuit boards discrete from each other but commonly positioned behind the contacts under a condition that the first printed circuit board is directly connected to a plurality of mounting legs for mounting to a third printed circuit board; wherein at least one set of electronic component defines two leads respectively mechanically and electrically connected to the first printed circuit board and the second printed circuit board so as to electrically connect said contacts to said mounting legs.

11. The electrical connector as claimed in claim 10, wherein said first printed circuit board and said second printed circuit board is angled with each other.

12. The electrical connector as claimed in claim 11, wherein an angle defined between said first and said second printed circuit board is 90 degrees.

13. The electrical connector as claimed in claim 11, wherein said first printed circuit board and said second printed circuit board are commonly supported by a substrate.

14. The electrical connector as claimed in claim 11, wherein said set of electronic component includes two differently oriented chokes.

* * * * *